US006672900B2

(12) United States Patent
France et al.

(10) Patent No.: US 6,672,900 B2
(45) Date of Patent: Jan. 6, 2004

(54) UNIVERSAL AFTERMARKET CONNECTOR

(75) Inventors: Ken France, Clemson, SC (US); Juergen Lampater, Nordheim (DE); Heinz Schoenborn, Easley, SC (US); Norman Hahn, Anderson, SC (US); Brad Pilgrim, Starr, SC (US); Craig Magera, Simpsonville, SC (US); David Greig, Roseville, MI (US)

(73) Assignee: Robert Bosch Corporation, Broadview, IL (US)

( * ) Notice: Subject to any disclaimer, the term of this patent is extended or adjusted under 35 U.S.C. 154(b) by 0 days.

(21) Appl. No.: 09/900,666

(22) Filed: Jul. 6, 2001

(65) Prior Publication Data

US 2002/0048991 A1 Apr. 25, 2002

Related U.S. Application Data

(60) Provisional application No. 60/242,490, filed on Oct. 23, 2000.

(51) Int. Cl.[7] ..... H01R 13/40
(52) U.S. Cl. ..... 439/587; 439/589
(58) Field of Search ..... 439/587, 784, 439/805, 428, 274, 275, 279, 589

(56) References Cited

U.S. PATENT DOCUMENTS

| | | | |
|---|---|---|---|
| 1,688,640 | A | 10/1928 | Levin |
| 2,447,340 | A | 8/1948 | Jackson |
| 2,688,651 | A | 9/1954 | Blake |
| 2,774,621 | A | 12/1956 | Kilbourne, Jr. |
| 2,906,552 | A | 9/1959 | White |
| 2,958,722 | A | 11/1960 | Rubin et al. |
| 3,122,597 | A | 2/1964 | Lemieux |
| 3,268,654 | A | 8/1966 | Morrison et al. |
| 3,337,681 | A | 8/1967 | Smith |
| 3,422,212 | A | 1/1969 | Clark |
| 3,515,798 | A | 6/1970 | Sievert |
| 3,612,746 | A | 10/1971 | Sankey |
| 4,123,131 | A | 10/1978 | Pearce, Jr. et al. |
| 4,193,655 | A | 3/1980 | Herrmann, Jr. |
| 4,230,392 | A | 10/1980 | Leonard, Jr. et al. |
| 4,501,927 | A | 2/1985 | Sievert |
| 4,560,219 | A | 12/1985 | Chapelot |
| 4,713,021 | A | 12/1987 | Kobler |
| 4,772,231 | A | 9/1988 | Hayes |
| 4,801,275 | A | 1/1989 | Ikeda et al. |
| 4,935,582 | A | 6/1990 | Calligaris |

(List continued on next page.)

FOREIGN PATENT DOCUMENTS

| | | |
|---|---|---|
| BE | 750729 | 5/1970 |
| DE | 661 265 | 8/1938 |
| DE | 1 159 536 | 12/1963 |
| DE | 19711376 | 12/1997 |
| WO | WO 83/00779 | 7/1982 |

*Primary Examiner*—Renee Luebke
*Assistant Examiner*—Ann McCamey
(74) *Attorney, Agent, or Firm*—Michael Best & Friedrich LLP

(57) ABSTRACT

A replacement kit for replacing an electrical device coupled to a vehicle via a plurality of vehicle lead wires. The replacement kit includes a replacement electrical device, a plurality of lead wires extending from the replacement electrical device, and a housing assembly for protecting a spliced connection formed with the lead wires to create an electrical connection between the electrical device and the vehicle. The housing assembly includes a base having a plurality of individually isolated bores extending therethrough. Each bore is capable of housing a spliced connection of a respective vehicle lead wire and a respective replacement electrical device lead wire, and each bore has therein a plurality of seal rings to form a substantially water-tight seal around the associated portion of the spliced connection. The housing assembly also includes a cap secured to the base. Preferably, the electrical device and the replacement electrical device are oxygen sensors.

9 Claims, 4 Drawing Sheets

U.S. PATENT DOCUMENTS 4,946,395 A 8/1990 Cope et al.
4,946,402 A 8/1990 Fink et al.
4,963,103 A 10/1990 Fink et al.
5,113,037 A 5/1992 King, Jr. et al.
5,122,081 A 6/1992 Bogiel et al.
5,145,402 A 9/1992 Plyler et al.
5,228,875 A 7/1993 Swenson, Sr.
5,308,261 A 5/1994 Kightlinger
5,371,323 A 12/1994 Schneider et al.
5,442,140 A 8/1995 Mc Grane
5,451,717 A 9/1995 Itou
5,490,785 A 2/1996 Hein et al.
5,574,259 A 11/1996 Meltsch et al.
5,685,729 A 11/1997 Reider et al.
5,695,369 A 12/1997 Swenson, Sr.
5,697,819 A 12/1997 Hatagishi
5,733,139 A 3/1998 Bray et al.
5,817,978 A 10/1998 Hermant et al.
5,868,589 A 2/1999 Swenson, Sr.
5,962,811 A 10/1999 Rodrigues et al.
5,980,319 A 11/1999 Yildiz et al.
6,005,300 A * 12/1999 Kelly ..... 307/10.1
6,095,859 A * 8/2000 Maeda ..... 439/587
6,257,938 B1 * 7/2001 Day et al. ..... 439/723

* cited by examiner

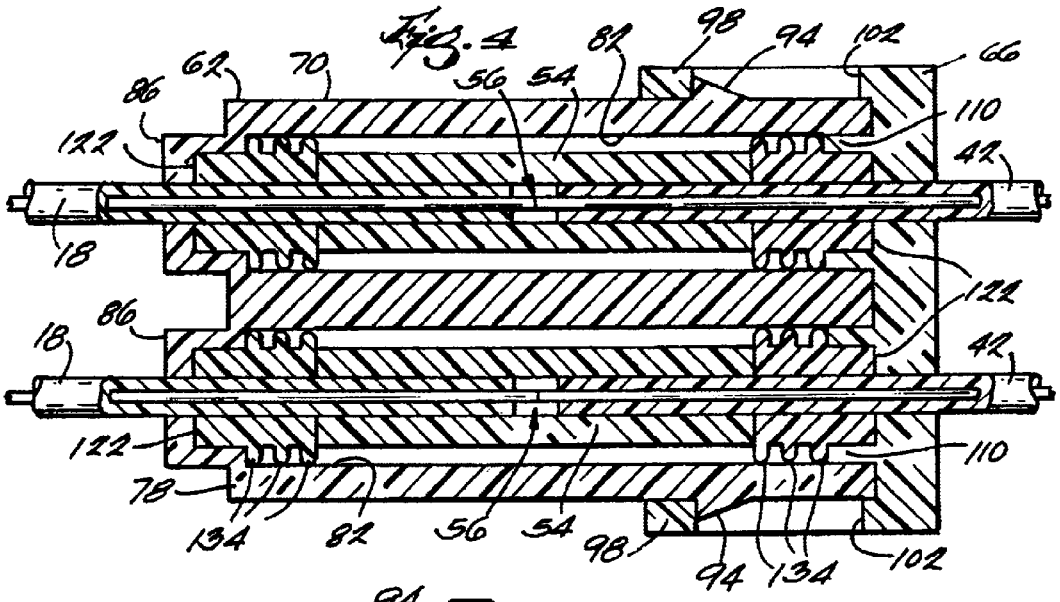
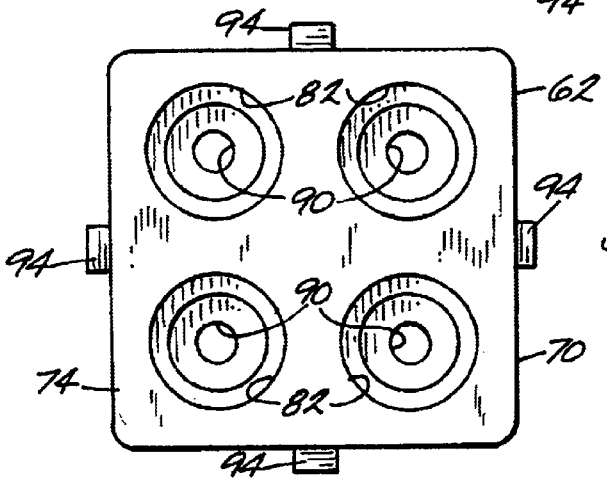
Fig. 5
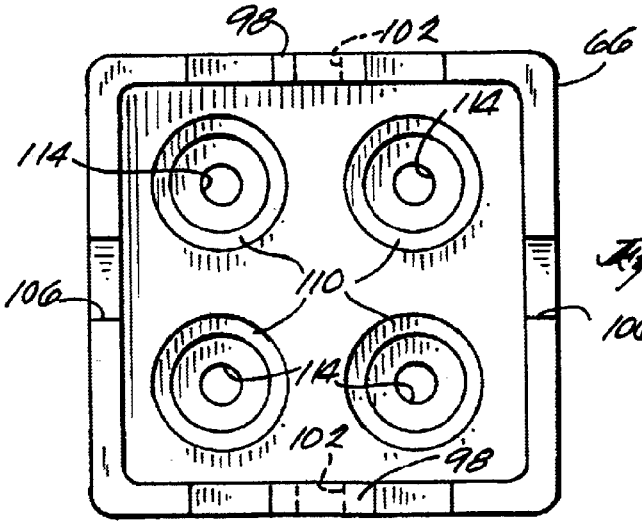
Fig. 6

UNIVERSAL AFTERMARKET CONNECTOR

RELATED APPLICATIONS

This application claims priority to provisional application Ser. No. 60/242,490, filed on Oct. 23, 2000.

FIELD OF THE INVENTION

The invention relates to electrical connections, and more particularly to methods and devices for forming electrical connections on automobiles.

BACKGROUND OF THE INVENTION

Automotive electrical systems include numerous electrical connections formed with various electronic modules and/or sensors on the automobile. One example of such an electrical connection is the connection formed between an exhaust gas oxygen sensor and the engine control unit (ECU). Exhaust gas oxygen sensors are mounted in the exhaust system and measure the oxygen content in the exhaust gases of an internal combustion engine. The electronic signal generated by the oxygen sensor is interpreted by the ECU to vary the air/fuel ratio of the mixture supplied to the engine.

Factory-installed oxygen sensors are electrically connected to the ECU using some form of a connector. Wire leads extending from the oxygen sensor terminate in a sensor-end connector, which can be male or female. The sensor-end connector is connected to a mating vehicle-end connector that is wired to the ECU. The two mating halves of the connector are usually made of plastic and provide a suitable watertight mechanical and electrical connection.

Each automobile manufacturer specifies a unique set of mating connectors to mate the oxygen sensor to the vehicle harness. Suppliers of the factory-installed oxygen sensors must provide oxygen sensor assemblies with this manufacturer-specified connector. While this compatibility requirement is to be expected when supplying original oxygen sensors to the vehicle manufacturers, it creates complexity when competing in the aftermarket (i.e., supplying replacement oxygen sensors).

Small repair shops and retail part suppliers typically do not have the inventory capacity to stock replacement oxygen sensor assemblies for every make and model of vehicle. If the required oxygen sensor assembly is not in stock, the replacement sensor assembly must be obtained from Original Equipment Manufacturers (OEM's), who will also not likely have the sensor in stock, and will need to order the sensor from their distribution center.

SUMMARY OF THE INVENTION

The present invention removes the need for the OEM's to supply the aftermarket. By facilitating a suitable mode of connection between a replacement oxygen sensor and the OEM connector, market complexity is greatly reduced. This reduced complexity benefits the consumer. The invention provides a replacement oxygen sensor that can be spliced to the existing oxygen sensor wiring harness irrespective of the design of the OEM connector.

Commonly used splicing techniques are also problematic. The original electrical and mechanical connection provided by the connector offers a reliable, watertight connection that can withstand the harsh environment of the under-carriage and under-hood of a vehicle. The new splice must also be well protected. Heat shrink tubing may not provide the long-term robustness required to prevent unwanted intrusions into the oxygen sensor.

The present invention addresses the compatibility issues associated with aftermarket oxygen sensor installation, and the resulting inadequacy of commonly used splicing techniques by providing a weather-resistant housing assembly for protecting a spliced electrical connection. The housing assembly includes a base having a plurality of individually isolated bores extending therethrough. Each bore is capable of housing a portion of the spliced connection and each bore has therein at least one seal ring to form a substantially water-tight seal around a portion of the spliced connection. The housing assembly also includes a cap secured to the base. The cap preferably includes a plurality of lead exit apertures. Each lead exit aperture corresponds to one of the respective bores.

In one aspect of the invention, the base has four sides and each of the four sides includes a projection. The cap also has four sides and two of the four sides of the cap include a resilient locking tab configured to engage one of the projections on the base. The cap can be secured to the base such that any one of the locking tabs engages any one of the projections. Preferably, the cap further includes a slot in each of the two sides that do not include the resilient locking tab. The slots receive the projections not engaged by the resilient locking tabs.

The invention also provides a universal aftermarket oxygen sensor replacement kit. The kit includes a replacement electrical device, a plurality of lead wires extending from the replacement electrical device, and a housing assembly for protecting a spliced connection formed with the vehicle lead wires and the replacement electrical device lead wires to create an electrical connection between the replacement electrical device and the vehicle. In a preferred embodiment, the replacement electrical device is an oxygen sensor.

The housing assembly includes a base having a plurality of individually isolated bores extending therethrough. Each bore is capable of housing a spliced connection of a respective vehicle lead wire and a respective replacement electrical device lead wire. The housing assembly also includes a plurality of seal rings. At least one seal ring is receivable in each bore to form a substantially water-tight seal around a portion of the spliced connection. The housing assembly further includes a cap that can be secured to the base.

The invention also provides a method of replacing an electronic device assembly on a vehicle. The electronic device assembly includes an electronic device, a device-end connector connected to a vehicle wire harness at a vehicle-end connector, and a plurality of lead wires extending between the electronic device and the device-end connector.

The method includes cutting the plurality of lead wires between the device-end connector and the electronic device, sliding a first portion of a splice housing onto the cut plurality of lead wires toward the device-end connector, providing a replacement electronic device having a plurality of replacement lead wires extending from the replacement electronic device, sliding a second portion of the splice housing onto the replacement lead wires toward the replacement electronic device, splicing the cut plurality of lead wires to the respective replacement lead wires, and sliding the first and second portions of the splice housing together over the spliced lead wires to connect the first and second portions of the splice housing and to substantially enclose the spliced lead wires.

In one aspect of the invention, splicing the cut plurality of lead wires to the respective replacement lead wires includes using splice connectors. In another aspect of the invention, sliding the first and second portions of the splice housing together includes isolating the respective spliced lead wires from one another in individually isolated bores extending through one of the first and the second portions of the splice housing.

Other features and advantages of the invention will become apparent to those skilled in the art upon review of the following detailed description, claims, and drawings.

BRIEF DESCRIPTION OF THE DRAWINGS

FIG. 4 is a section view illustrating the splice and the protective housing surrounding the splice.

FIG. 5 is an end view of the base of the protective housing of FIG. 3.

FIG. 6 is an end view of the cap of the protective housing of FIG. 3.

Figure 1:
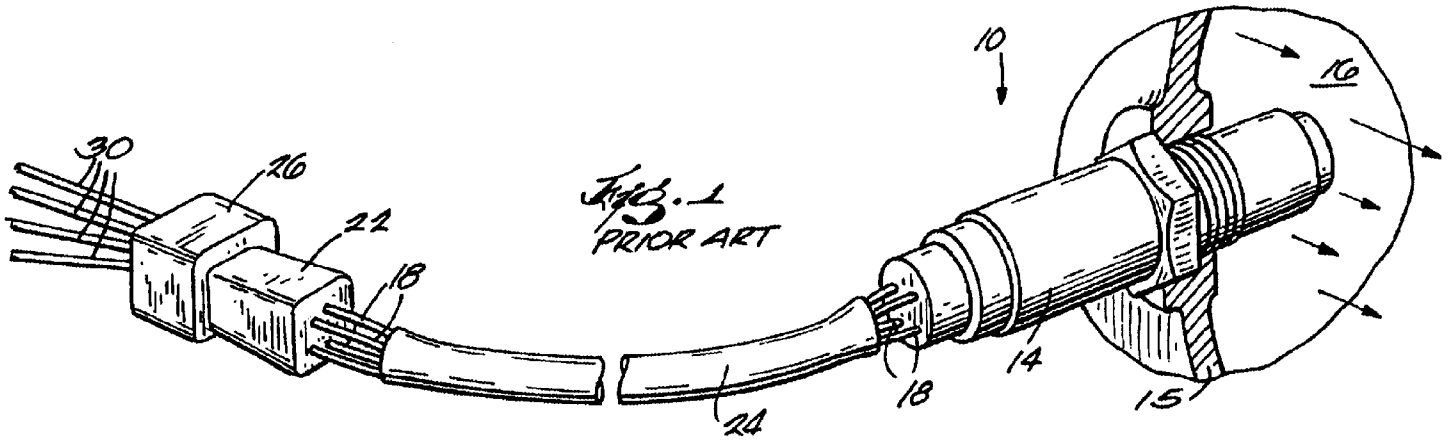
Fig. 1 PRIOR ART
FIG. 1 is a perspective view of a typical, factory-installed oxygen sensor arrangement for a vehicle.

Before one embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including" and "comprising" and variations thereof herein is meant to encompass the items listed thereafter and equivalents thereof as well as additional items.

DETAILED DESCRIPTION OF THE PREFERRED EMBODIMENT

FIG. 1 illustrates a typical connection arrangement for a factory-installed, original oxygen sensor assembly 10. The oxygen sensor assembly 10 includes an oxygen sensor 14 that can be mounted in the vehicle's exhaust system, indicated generally at 15. While shown as being threaded directly into the vehicle's exhaust system 15, the sensor may also be mounted via a flange (not shown) attached to the oxygen sensor. The oxygen sensor 14 is mounted such that a portion of the sensor is positioned within the stream of exhaust gases 16 (indicated by the arrows in FIG. 1). Insulated sensor leads 18 extend from the oxygen sensor 14, and a sensor-end connector 22 is connected to the ends of the sensor leads 18. The number of sensor leads 18 can vary depending upon the particular oxygen sensor 14 being used. Typically, there are either three or four sensor leads 18. A flexible sleeve 24 can be used to contain and protect the sensor leads 18.

The oxygen sensor assembly 10 is electrically connected to the vehicle's engine control unit (ECU) (not shown) via a vehicle-end connector 26. Insulated vehicle-end leads 30 extend from the ECU and terminate at the vehicle-end connector 26.

As described above in the background of the invention, each vehicle manufacturer specifies the vehicle and the respective oxygen sensor connectors 22 and 26. The suppliers who provide the oxygen sensor assembly 10 to the manufacturers must design the oxygen sensor assembly 10 to include this customer-specified connector. The connectors 22, 26 provide a mechanical and electrical connection between the oxygen sensor 14 and the ECU that is suitably protected from the environment. Because the present invention operates without regard to the specific connector 22, 26 configurations, the specific configuration of the sensor-end connector 22 and the vehicle-end connector 26 shown in FIG. 1 will not be described further.

As shown in FIGS. 2–7, the invention provides a universal oxygen sensor assembly replacement kit 34 that is particularly suitable for sale in the aftermarket. The replacement kit 34 replaces pre-existing factory-installed oxygen sensor assemblies, regardless of the specific configuration of the vehicle-end connector 26 and sensor-end connector 22.

Figure 2:
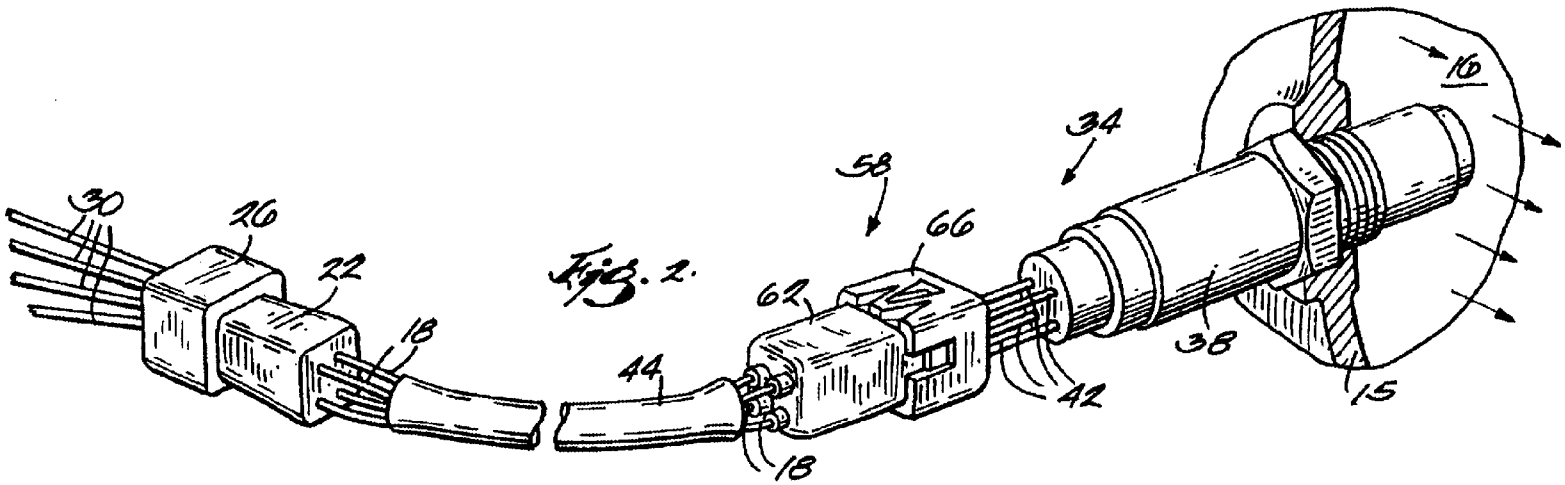
FIG. 2 is a perspective view showing an oxygen sensor replacement kit embodying the invention, replacing the factory-installed oxygen sensor of FIG. 1.
Figure 3:
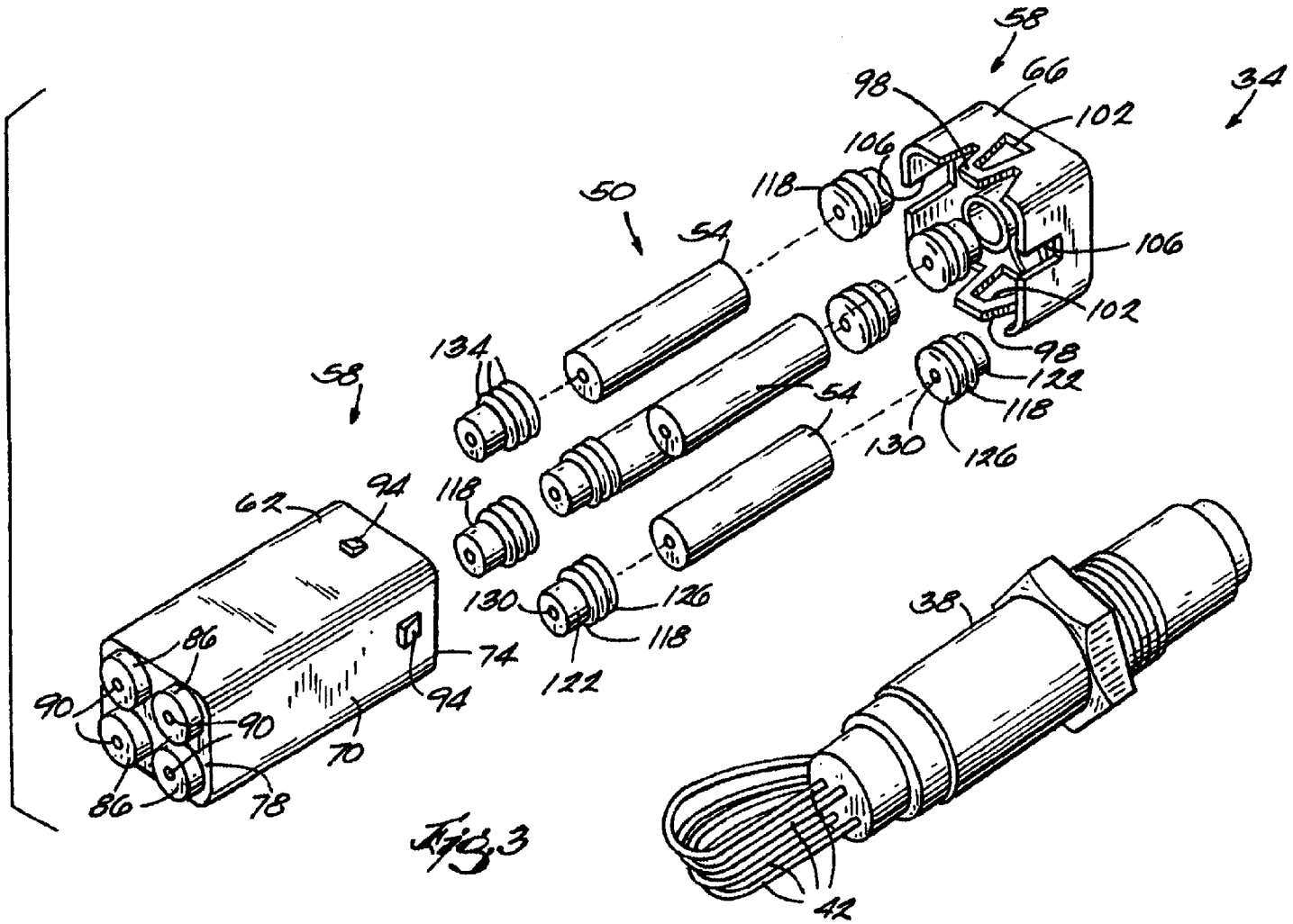
FIG. 3 is an exploded perspective view of the oxygen sensor replacement kit.

As best seen in FIG. 3, the replacement kit 34 includes an oxygen sensor 38 having the associated insulated sensor leads 42 and flexible sleeve 44 (see FIG. 2). Again, the number of leads 42 can vary, with three or four leads 42 being the most common. Unlike with the oxygen sensor assembly 10, the sensor leads 42 do not terminate at a sensor-end connector. Rather, each of the sensor leads 42 terminates at a free end 46 (see FIG. 7). The insulation on the leads 42 can extend to the free ends 46 or can be partially removed to expose respective portions of the conductive wire in preparation for splicing.

The replacement kit 34 preferably also includes splice supplies 50 for splicing the free ends 46 to the original sensor leads 18 as will be described below. In the illustrated embodiment, the splice supplies 50 are in the form of four individual POSI-LOCK no-crimp connectors 54. The connectors 54 are available from Swenco Products located in Poplar Bluff, Mo., and are the subject of U.S. Pat. Nos. 5,228,875, 5,695,369, 5,868,589, and other pending applications. FIG. 4 illustrates a completed splice, generally indicated as 56. The splice supplies 50 can alternatively be any other suitable devices for splicing, including various butt connectors (not shown). Use of such butt connectors may require some additional componentry (not shown).

The replacement kit 34 also includes a two-piece protective housing 58 having a base 62 and a cap 66. The protective housing 58 is assembled over the spliced leads 18 and 42 to capture the splice 56 and to protect the splice 56 from the environment. As best seen in FIGS. 3–5 and 7–8, the base 62 includes a body portion 70 having a splice receiving end 74 (for splices 50 and wire seals 118) and a lead exit end 78. The body portion 70 includes four individually isolated bores 82 extending between the ends 74 and 78. The bores 82 each have a first diameter that remains substantially constant over the majority of the body portion 70.

Bosses 86 are formed adjacent the end 78. As shown in FIG. 4, the bores 82 are stepped at the bosses 86 such that inside the bosses 86, the bores 82 have a second diameter that is slightly smaller than the first diameter. The purpose of the bosses 86 and the reduced second diameter will be described below. The end surfaces of the bosses 86 include (see FIG. 5) lead exit apertures 90 communicating with the respective bores 82. The apertures 90 each have a diameter that is smaller than both the first and second bore diameters. The apertures 90 provide an exit from the base 62 for the leads 18 or 42.

The base 62 also includes projections 94 on each side of the body portion 70, adjacent the end 74. The projections 94 secure the base 62 to the cap 66 as described below.

The cap 66 is sized to fit over the end 74 of the base 62 as shown in FIG. 4. The cap 66 includes two resilient locking tabs 98 spaced 180 degrees from one another on opposing sides of the cap 66. The tabs 98 include openings 102 for receiving the projections 94. As the cap 66 is pressed onto the base 62, the ramped surface of the projections 94 deflects the tabs 98 outward until the projections 94 are completely within the openings 102, at which point the tabs 98 snap into place over the projections 94. The remaining two sides of the cap 66 include slots 106 that slidably receive the remaining two projections 94. The illustrated tab/projection securing method allows the cap 66 to be secured to the base 62 regardless of the respective orientations of the base 62 and the cap 66.

As best seen in FIGS. 4 and 6, the cap 66 also includes bosses 110 having an inner diameter substantially equal to the second diameter described above with respect to the bores 82 and the bosses 86. The purpose of the bosses 110 will be described below. The end surfaces of the bosses 110 include lead exit apertures 114 communicating with the inside of the bosses 110 and the inside of the cap 66. The apertures 114 preferably have the same diameter as the apertures 90 and provide an exit from the cap 62 for the leads 18 or 42.

The housing 58 is preferably made from injection molded plastic, but could be made from any other suitable materials. The housing 58 is not limited to the configuration shown in the figures. In particular, the housing 58 could be modified to accommodate fewer or more leads. Additionally, other securing structure could be used to secure the cap 66 to the base 62.

Figure 7:
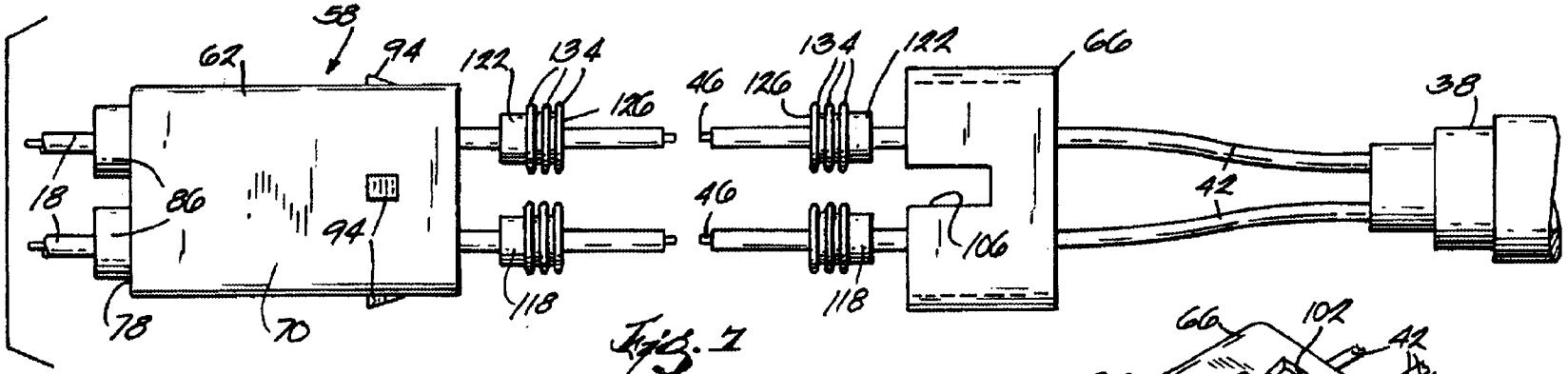
FIGS. 7 and 8 illustrate the steps of making the spliced connection when installing the oxygen sensor replacement kit of FIG. 2.
Figure 8:
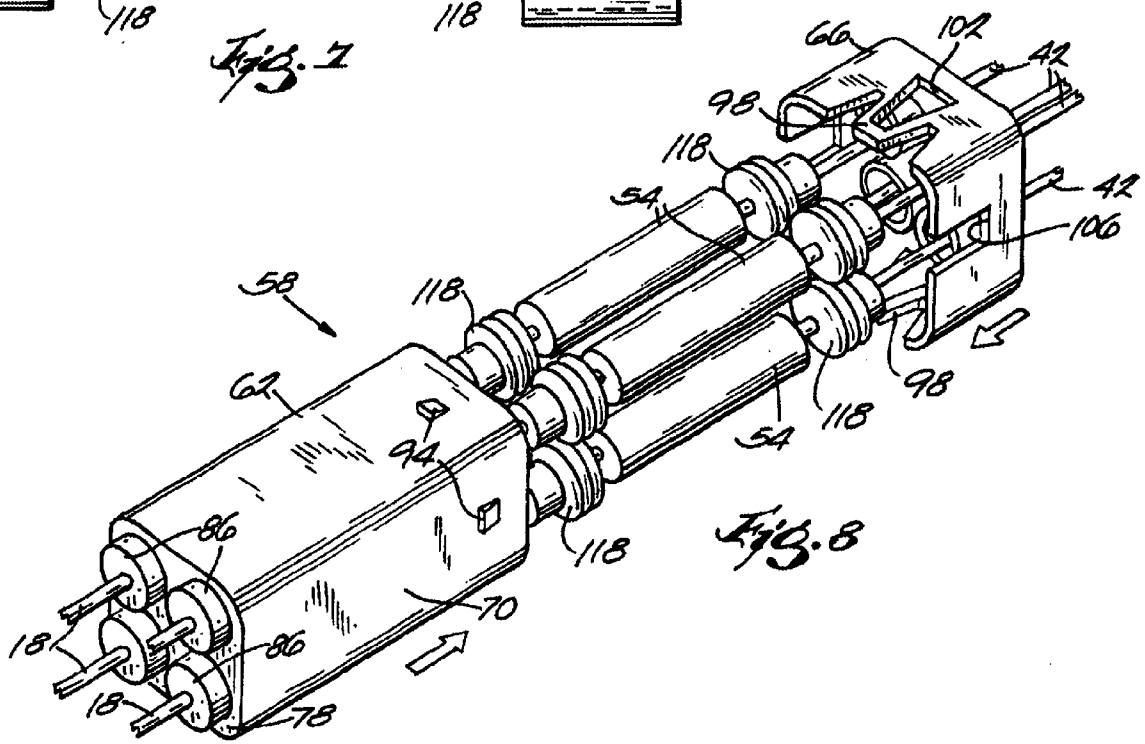

The replacement kit 34 also includes a plurality of seal rings 118 for providing a watertight seal around the splice 56. The seal rings 118 each include a nose portion 122 and a ribbed portion 126. A lead receiving hole 130 (see FIG. 3) extends through the center of the seal ring 118. As best seen in FIGS. 4, 7, and 8, a lead 18 or 42 can be inserted into the hole 130, allowing the seal ring 118 to be slid over the lead 18 or 42 to provide a water-tight fit between the lead 18 or 42 and the seal ring 118. The nose portion 122 is receivable in the reduced-diameter portion of the bosses 86 or 110. The ribbed portion 126 includes a plurality of ribs 134 that engage the inside of the body portion 70 in the bore 82 to provide a water-tight seal between the splice 56 and the base 62.

The seal rings 118 are made from any suitable elastomeric material, such as silicon rubber. The replacement kit 34 is shown to include eight seal rings 118, but fewer or more seal rings 118 can be included, depending on the number of leads 42. Furthermore, the ribbed portions 126 can include fewer or more than three ribs 134. Of course, other seal ring configurations can also be used.

In FIG. 4, each opposing pair of seal rings 118 is shown to directly abut opposite ends of the connector 54. It should be noted that the seal rings 118 can also be spaced from the ends of the connector 54 without deviating from the invention. In other words, the seal rings 118 are sized to sealingly engage the bores 82 regardless of whether or not the seal rings 118 directly abut, or are even slightly compressed by engagement with the connectors 54. This provides added flexibility to use various different types of splice supplies 50. Of course, compressing the seal rings 118 with the connectors 54 to cause radial expansion of the seal rings 118 can be an additional or an alternative technique to obtain the desired sealing.

The method of installing the universal oxygen sensor assembly replacement kit 34 will now be described. First, the original oxygen sensor 14 is removed by cutting the original sensor leads 18 between the oxygen sensor 14 and the sensor-end connector 22. A sufficient length of sensor lead should remain to facilitate installation of the replacement kit 34. Next, the housing 58 and the seal rings 118 are installed as shown in FIG. 7. The base 62 is mounted on the original sensor leads 18 by passing the cut leads through the respective exit apertures 90. The base 62 can then be slid over the leads 18 toward the sensor-end connector 22. Next, four of the seal rings 118 are slidably mounted on the leads 18 as shown.

The cap 66 is mounted on the leads 42, which are connected to the replacement sensor 38. The free ends 46 are passed through the respective exit apertures 114, and the cap 66 is slid toward the sensor 38. The four remaining seal rings 118 are slidably mounted on the leads 42 as shown. Of course, the base 62 and the cap 66 can be reversed such that the base 62 is mounted on the leads 42 and the cap is mounted on the leads 18. The order of the installing the base 62 and the cap 66 can also be reversed.

Next, as shown in FIG. 8, the cut ends of the leads 18 and the free ends 46 are spliced together using the connectors 54 or any other suitable splice supplies 50. Again, the splice 56 can also be formed via welding or soldering. With the splice 56 completed, the base 62 and the cap 66 can be moved together in the direction of the arrows in FIG. 8. As the base 62 and cap 66 are moved together, the nose portions 122 of the seal rings 118 will become seated in the respective bosses 86, 110 and the ribs 134 will engage the inside of the base 62 defining the respective bores 82. The base 62 and cap 66 are moved together until the tabs 98 snap over the respective projections 94. The splice 56 creates the electrical connection, and the splice 56 is protected from the environment by the housing 58 and the seal rings 118. FIG. 2 illustrates the arrangement of the installed universal oxygen sensor assembly replacement kit 34.

The installation method is substantially the same regardless of whether there are three or four sensor leads 42 extending from the new sensor 38. If only three leads 42 are present, one of the bores 82 will remain empty. Because the bores 82 are isolated from one another inside the body portion 70, any water entering the empty bore 82 via the corresponding exit apertures 90, 114 will not come into contact with the splices 56 in the three remaining bores 82. Of course, the base 62 of the housing 58 could be modified to include fewer or more than four bores 82. Such a modification would likely require a corresponding modification to the cap 66.

While the preceding description of the preferred embodiment describes the present invention as being used for connecting an oxygen sensor, it should be understood that the present invention could also be used for any connection requiring a weatherproof splice. The present invention is particularly suitable for electrical connections involving components that require occasional or periodic replacement. The present invention is also well suited for lengthening a wire set that is subjected to a corrosive environment. For example, the present invention would be well suited for lengthening or replacing the electrical lighting connection between a vehicle and a trailer, especially when the trailer is submersible, such as for boats and other watercraft. Replacing other electrical devices, which are connected in a similar arrangement to the oxygen sensor assembly 10, is also contemplated.

Various features of the invention are set forth in the following claims.

What is claimed is:

1. A weather-resistant housing assembly for protecting a spliced electrical connection, the housing assembly comprising:

a base having a plurality of individually isolated bores extending therethrough, each bore being capable of housing a portion of the spliced connection, and each bore having therein at least one seal ring to form a substantially water-tight seal around a portion of the spliced connection; and a cap secured to the base wherein the base has four sides and each of the four sides includes a projection, wherein the cap has four sides and two of the four sides of the cap include a resilient locking tab configured to engage one of the projections, and wherein the cap can be secured to the base such that any one of the locking tabs engages any one of the projections; and wherein the cap further includes a slot in each of the two sides that do not include the resilient locking tab, the slots being configured to receive the projections not engaged by the resilient locking tabs.

2. The housing assembly of claim 1, wherein each individually isolated bore has therein two spaced-apart seal rings with the spliced connection between the rings so that the rings form a substantially water-tight seal around the spliced connection, and wherein the cap includes a boss corresponding to each individually isolated bore in the base, each boss in the cap retaining a respective one of the two seal rings in each individually isolated bore.

3. A replacement kit for replacing an electrical device coupled to a vehicle via a plurality of vehicle lead wires, the replacement kit comprising:

a replacement electrical device;

a plurality of lead wires extending from the replacement electrical device; and a housing assembly for protecting a spliced connection formed with the vehicle lead wires and the replacement electrical device lead wires to create an electrical connection between the replacement electrical device and the vehicle, the housing assembly including:

a base having a plurality of individually isolated bores extending therethrough, each bore being capable of housing a spliced connection of a respective vehicle lead wire and a respective replacement electrical device lead wire;

a plurality of seal rings, at least one seal ring being receivable in each bore to form a substantially water-tight seal around a portion of the spliced connection; and a cap that can be secured to the base;

wherein the base has four sides and each of the four sides includes a projection, wherein the cap has four sides and two of the four sides of the cap include a resilient locking tab configured to engage one of the projections, and wherein the cap can be secured to the base such that any one of the locking tabs engages any one of the projections; and wherein the cap further includes a slot in each of the two sides that do not include the resilient locking tab, the slots being configured to receive the projections not engaged by the resilient locking tabs.

4. The replacement kit of claim 3, wherein there are two seal rings receivable in each individually isolated bore with the spliced connection between the rings so that the rings form a substantially water-tight seal around the spliced connection, and wherein the cap includes a boss corresponding to each individually isolated bore in the base, each boss in the cap being configured to retain a respective one of the two seal rings receivable in each individually isolated bore.

5. A replacement kit for replacing an oxygen sensor coupled to a vehicle via a plurality of vehicle lead wires, the replacement kit comprising:

an oxygen sensor;

a plurality of lead wires extending from the oxygen sensor; and a housing assembly for protecting a spliced connection formed with the vehicle lead wires and the oxygen sensor lead wires to create an electrical connection between the oxygen sensor and the vehicle, the housing assembly including:

a base having a plurality of individually isolated bores extending therethrough, each bore being capable of housing a spliced connection of a respective vehicle lead wire and a respective oxygen sensor lead wire;

a plurality of seal rings, two seal rings being receivable in each bore with the spliced connection between the rings so that the rings form a substantially water-tight seal around the spliced connection; and a cap that can be secured to the base, the cap including a plurality of lead exit apertures, each lead exit aperture corresponding to a respective one of the bores;

wherein the cap includes a boss corresponding to each individually isolated bore in the base, each boss in the cap being configured to retain a respective one of the two seal rings receivable in each individually isolated bore.

6. The combination of a spliced electrical connection, including a splice formed by a spliced pair of wire leads, and a weather-resistant housing assembly for protecting the spliced electrical connection, the housing assembly having a length and comprising:

a base having a plurality of individually isolated bores extending therethrough; and a cap secured to the base, the cap including a plurality of apertures, each aperture corresponding to a respective one of the bores;

wherein each aperture and corresponding bore define one of a plurality of chambers passing through the length of the housing assembly, each of the chambers being isolated from communication with the remaining chambers over the entire length of the housing assembly; and wherein at least one of the plurality of chambers includes two spaced-apart seal rings with the splice between the rings so that the rings form a substantially water-tight seal around the splice.

7. The combination of claim 6, wherein the two seal rings are in the base.

8. The combination of claim 6, wherein the spliced electrical connection includes more than one splice, and wherein each of the plurality of chambers includes two spaced-apart seal rings with a splice between the rings so that the rings form a substantially water-tight seal around the splice.

9. The combination of claim 6, wherein there are four chambers and wherein there are one to four splices in the housing assembly, with no more than one splice in any one chamber.

* * * * *